United States Patent [19]

Hamano et al.

[11] Patent Number: 4,702,629

[45] Date of Patent: Oct. 27, 1987

[54] APPARATUS FOR ADJUSTING THE PRINT HEAD GAP IN A DOT MATRIX PRINTER

[75] Inventors: Tsutomu Hamano, Odawara; Hiroshi Shikano, Nagoya, both of Japan

[73] Assignee: NCR Corporation, Dayton, Ohio

[21] Appl. No.: 806,718

[22] Filed: Dec. 9, 1985

[30] Foreign Application Priority Data

Dec. 28, 1984 [JP] Japan ..... 59-282139

[51] Int. Cl.[4] ..... B41J 11/20

[52] U.S. Cl. ..... 400/56; 400/59; 400/636.3; 400/642; 400/662

[58] Field of Search ..... 400/55, 56, 57, 58, 400/59, 124, 352, 353, 354, 354.3, 636, 636.3, 642, 662

[56] References Cited

U.S. PATENT DOCUMENTS

| | | | |
|---|---|---|---|
| 3,960,256 | 6/1976 | Bickoff et al. | 400/55 |
| 3,999,749 | 12/1976 | Zambolin et al. | 400/636 |
| 4,056,183 | 11/1977 | Beery | 400/124 |
| 4,086,997 | 5/1978 | Wu | 400/57 |
| 4,088,215 | 5/1978 | Bader | 400/56 |
| 4,090,600 | 5/1978 | Biedermann | 400/213 |
| 4,134,695 | 1/1979 | Randolph | 400/59 |
| 4,165,188 | 8/1979 | Rempel | 400/124 |
| 4,243,331 | 1/1981 | Savage et al. | 400/59 |
| 4,383,775 | 5/1983 | Trammell et al. | 400/208 |
| 4,420,269 | 12/1983 | Ackermann et al. | 400/356 |
| 4,422,782 | 12/1983 | Lawter et al. | 400/636 |
| 4,425,047 | 1/1984 | Narushima | 400/636 |
| 4,439,051 | 3/1984 | Lawter | 400/636 |
| 4,483,633 | 11/1984 | Kosner et al. | 400/82 |
| 4,492,484 | 1/1985 | Akazawa et al. | 400/248 |
| 4,493,566 | 1/1985 | McMahon et al. | 400/59 |
| 4,496,256 | 1/1985 | McMorrow et al. | 400/248 |
| 4,556,333 | 12/1985 | Stefansson | 400/58 |

FOREIGN PATENT DOCUMENTS

| | | | |
|---|---|---|---|
| 49587 | 3/1982 | Japan | 400/55 |

OTHER PUBLICATIONS

T. E. Schall; "Platen Inking Back Printer"; *IBM Tech. Disc. Bull.;* vol. 21, No. 9, pp. 3729–3730; Feb. 1979.

*Primary Examiner*—Edgar S. Burr
*Assistant Examiner*—David A. Wiecking
*Attorney, Agent, or Firm*—Wilbert Hawk, Jr.; Albert L. Sessler, Jr.; George J. Muckenthaler

[57] ABSTRACT

A dot matrix printer utilizes an inking roller for supplying ink to the surface of the printer platen and has guide means adjacent the platen to separate the print paper from the platen. The guide means includes an elongated slot or window for access to the platen by the print wires. The print wire support means is spring loaded in a direction toward the platen and utilizes a solenoid to move the support means away from the platen. A pair of rollers is engageable with the paper and positioned between the platen and the print element carriage to form a predetermined space between the paper and the end of the print wire when the carriage is moved toward the platen.

10 Claims, 5 Drawing Figures

APPARATUS FOR ADJUSTING THE PRINT HEAD GAP IN A DOT MATRIX PRINTER

BACKGROUND OF THE INVENTION

In the field of printing, the most common type of printer has been the printer which impacts against record media that is caused to be moved past a printing line or line of printing. As is well-known, the impact printing operation depends upon the movement of impact members, such as print hammers or wires or the like, which are typically moved by means of an electromechanical-type system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the armature or plunger normally operates against the action of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and journal printing operation, the print head structure may be a multiple element type and horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form or record media while the carriage and print head are moved above and across the form or media in the horizontal direction.

Further, the printer structure may be an arrangement which includes a plurality of equally-spaced, horizontally-aligned, single element print heads which are caused to be moved in back and forth manner to print successive lines of dots in making up the lines of characters. In this latter arrangement, the drive elements or transducers are individually supported along a line of printing. These single wire actuators or solenoids are generally tubular or cylindrically shaped and include a shell which encloses a coil, an armature and a resilient member arranged in manner and form wherein the actuator is operable to cause the print wire to be axially moved a small precise distance in dot matrix printing.

In the case of a wire matrix printer which is utilized for form or multi-copy printing, the difference in thickness of the forms or copies may require some means or mechanism for adjusting the gap or the distance between the print head and the printer platen. It is in the field of printers and more specifically in the field of dot matrix printers for use in cash registers or like register machines that the subject matter of the present invention is most closely associated and which invention provides for improved and advantageous positioning and control of the gap or distance between the print head and the printer platen.

Conventionally, an ink ribbon has been incorporated in the mechanism of a dot matrix printer which ribbon is caused to be positioned by guiding and/or driving same in the area between the print head and the paper or like record media for the purpose of transferring ink onto the paper from the ink ribbon during printing operation. Further, it is known that the dot matrix printer mechanism for a cash register is constructed so that the platen is moved away from the print head when paper is inserted into the printer.

However, in such a conventional dot matrix printer, the use of an ink ribbon and the associated containing, guiding, and driving means can become complicated in providing the required transfer of ink from the ribbon to the paper. It is further noted that the printer that is utilized for cash registers or like machines should be compact in nature along with a reduced platen size and a reduction in width of the printer, thus permitting a lesser distance of print head travel in the longitudinal direction of the platen.

Representative documentation in the field of wire matrix print heads includes U.S. Pat. No. 3,960,256, issued to C. Bickoff et al. on June 1, 1976, which discloses an adjustable carriage apparatus wherein the print head is secured to a carriage whose position may be adjusted with respect to the paper by rotating a pair of bearings.

U.S. Pat. No. 4,086,997, issued to E. S. Wu on May 2, 1978, discloses an adjustable support for a print head assembly which changes the spacing between the print head and the paper supporting surface to accommodate multiple sheets of paper and to facilitate changing of paper and ribbon.

U.S. Pat. No. 4,088,215, issued to L. Bader on May 9, 1978, discloses record media compensation means including a motor for positioning a printer frame for locating the print head at a proper distance from the record media.

U.S. Pat. No. 4,090,600, issued to H. H. Biedermann on May 23, 1978, discloses a printing device having a fixed guide bar supporting a flexible strip which serves to press the paper against the platen and serves as a track for print head guide rollers. The guide bar guides paper insertion and provides a camming surface to rock the ribbon cassette upon traversal of the print head.

U.S. Pat. No. 4,165,188, issued to W. D. Rempel on Aug. 21, 1979, discloses a ribbon mask and guide carried with the print head and positioned between the print ribbon and the printing surface and the mask has an oval opening for the print wires.

U.S. Pat. No. 4,243,331, issued to J. G. Savage et al. on Jan. 6, 1981, discloses apparatus for adjusting a carriage relative to a platen including support rails, a tubular housing and a C-shaped member supported from the support rails for pivotal and translational movement.

U.S. Pat. No. 4,383,775, issued to K. L. Trammell et al. on May 17, 1983, discloses a ribbon shield for use with a cassette which snaps into the front of the cassette to cover an exposed portion of ribbon. The shield has a central aperture for the ribbon to pass through it and a curved portion to accommodate paper motion past the cassette.

U.S. Pat. No. 4,420,269, issued to R. Ackermann et al. on Dec. 13, 1983, discloses a device for lifting the printing head off the platen which includes means for changing the distance between the print element and the platen an amount to facilitate paper feeding and an additional amount for paper insertion.

U.S. Pat. No. 4,483,633, issued to J. J. Kosner et al. on Nov. 20, 1984, discloses a matrix print head printer wherein back-up platen rollers are moved from a first position adjacent the print head when actuated to a second position distal from the print head when the print head is not actuated. The printer also includes an ink source comprising an endless ink ribbon and an ink guard disposed between the ribbon and the document path with apertures in the guard for printing operation.

U.S. Pat. No. 4,492,484, issued to H. Akazawa et al. on Jan. 8, 1985, discloses a ribbon mask and guide for wire dot printers wherein a carriage supported print head includes a nose member on first and second holding members disposed on the carriage and the ribbon mask is removably held between first and second members.

U.S. Pat. No. 4,493,566, issued to R. G. McMahon et al. on Jan. 15, 1985, discloses a front to back adjustment for a carriage assembly which has first and second parallel supports, a pulley support assembly on one support, and a bearing assembly on the other support.

And, U.S. Pat. No. 4,496,256, issued to H. L. McMorrow et al. on Jan. 29, 1985, discloses an impact printing apparatus which has a ribbon mask angled at either side of the print head and a slot in the mask extends at an angle so that the slot ends do not engage the paper being printed.

SUMMARY OF THE INVENTION

The present invention relates generally to dot matrix printers. More particularly, the present invention relates to means providing an ink supply in the form of an inking roller which extends across and is supported from the sides of the printer. A plurality of dot forming print elements are arranged and supported in the longitudinal direction of a platen and placed in opposing relationship therewith. The print elements are carried on a frame member which is reciprocatingly moved along the platen in printing operation, such operation being accomplished by use of a print wire of each print element being impacted against paper or like record media and causing the paper to be impacted against the platen. The inking roller is supported from the printer so as to be in contact with and adapted to supply ink to the surface of the platen to enable transfer of ink therefrom to the paper upon impact thereof by the print wires. Guide means are provided to guide and support the print paper so that the paper is not in contact with the platen at all times, specifically when the paper is being advanced past the printing station.

The frame member for carrying the printing elements is supported from the printer in a manner permitting such member to be moved toward and away from the printing surface of the platen. The frame member is normally urged toward the platen by means of a pair of springs located at the sides of the printer, and such member is moved away from the platen by electromagnetic means in the form of a solenoid and lever arrangement on the printer. When paper is to be inserted into the printer, the solenoid is energized and the print element carriage is moved away from the platen for insertion of the paper, after which the springs urge the carriage toward the platen for printing operation. The printing operation is accomplished by reason that the print paper is pressed into contact with the surface of the inked platen by means of the print wires forming dots on the side of the paper opposite the print wires.

In view of the above discussion, the principal object of the present invention is to provide a dot matrix printer for use in a cash register or like machine.

Another object of the present invention is to provide a dot matrix printer having an inking roller for supplying ink to the printer platen.

An additional object of the present invention is to provide a dot matrix printer with means for protecting the paper during printing operation and means for guiding the print paper past the platen.

A further object of the present invention is to provide a dot matrix printer having means for supporting the printing elements for movement thereof in a direction longitudinally of the printer platen or in transverse direction across the printer.

Still another object of the present invention is to provide a dot matrix printer having means for supporting the printing elements for movement thereof in a direction toward and away from the printer platen.

Still a further object of the present invention is to provide a dot matrix printer having means for supporting the printing elements and solenoid means for moving the printing element support means a predetermined distance from the platen.

Additional advantages and features of the present invention will become apparent and fully understood from a reading of the following description taken together with the annexed drawing.

DESCRIPTION OF THE PREFERRED EMBODIMENT

Figure 1:
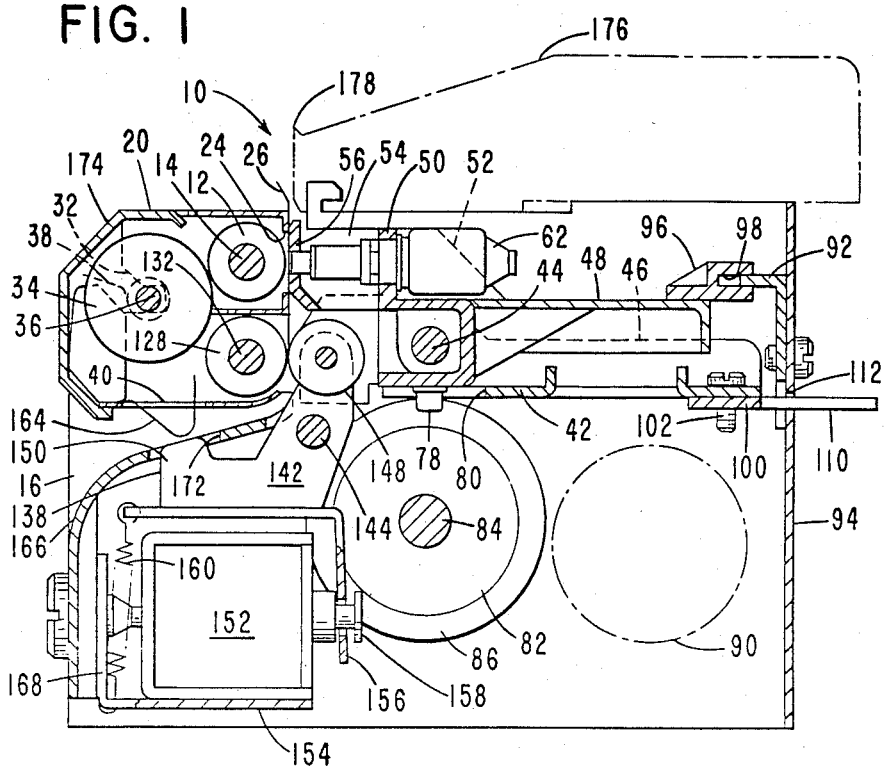
FIG. 1 is a side elevational view illustrating a dot matrix printer incorporating the subject matter of the present invention.
Figure 2:
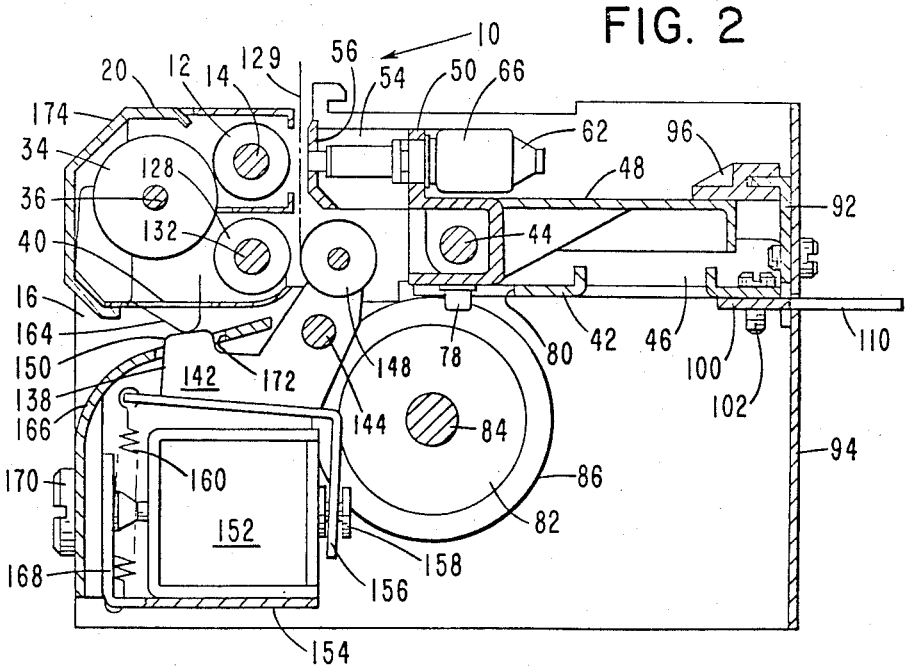
FIG. 2 is a side elevational view of the dot matrix printer of FIG. 1 and illustrating the position of certain parts when inserting printing paper.

Referring now to FIGS. 1 and 2, there is illustrated a preferred embodiment of the present invention and incorporating subject matter of the dot matrix printer 10. A platen 12 is carried on a shaft 14 suitably journaled or supported at both side walls 16 and 18 of the frame of the dot matrix printer 10. It is noted that the left side of FIGS. 1 and 2 is considered the front of the printer 10. A protection framework 20 is provided between the side walls 16 and 18 and secured thereto so as to surround the peripheral surface of the platen 12. In the back side wall 22 of the protection framework 20, there is formed a slit 24 (FIG. 5) extending from left to right along the longitudinal direction of the protection framework 20 and of the platen 12. A paper guide 26, (FIGS. 1 and 5) prepared by bending a thin material plate, is fixed on the outer surface of the back side wall 22 of the protection framework 20, and a slit 28 is formed in the central portion of the paper guide, the slit 28 being thinner than the slit 24 in framework 20.

A supporting-type groove 32 (FIG. 1) is formed in each of the side walls 16 and 18 of the printer frame in front of the platen 12, and an inking roller 34, which is wetted by and preferably saturated with ink, is rotatably and movably mounted in back-and-forth manner in the supporting-type grooves 32 by means of the shaft 36 which is provided for carrying the roller 34 and extends on both sides of the inking roller. The inking roller 34 is slightly compressed as the result of being urged in the direction so as to be in contact with the platen 12 by a leaf spring 38 attached on a guide plate 40, which will be described later. The rotation of the platen 12 is followed by the rotation of the inking roller 34 and thus the ink on the inking roller is applied to the peripheral surface of the platen.

Figure 5:
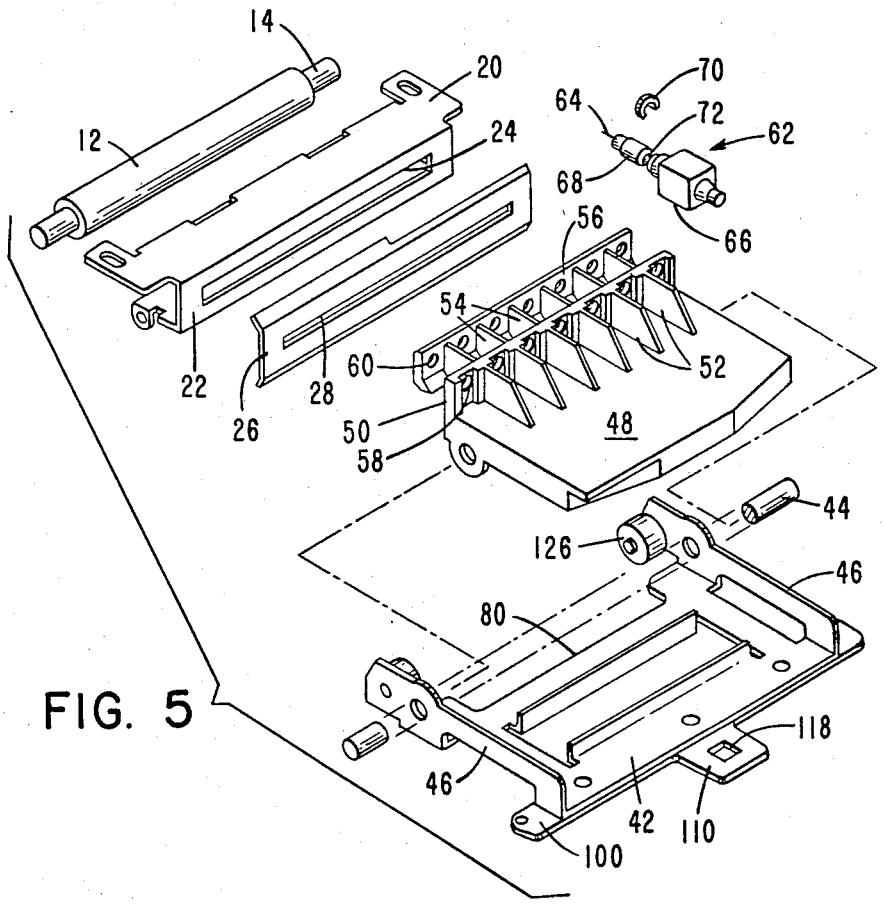
FIG. 5 is an exploded, perspective view of portions of the dot matrix printer.

A base plate 42 is movably supported in back-and-forth manner on the printer frame to the rear of the platen 12, and a supporting shaft 44 is inserted into and supported by the front portion of an upstanding member 46 (FIG. 5) on both sides of the base plate 42. A print head carrying structure or framework 48 (FIG. 5) is supported by the shaft 44 on the base plate 42 in a manner so as to allow longitudinal movement of such structure 48 in both directions along the platen 12 and also supported in manner and form by the printer to be capable of being moved in the direction toward the platen 12. As shown in FIGS. 1, 2 and 5, a supporting wall 50, which extends in both right and left directions, is integrally formed on the front side portion of the head framework 48 and a plurality of partitions 52 and 54 are integrally formed at regular intervals on the upper face of the head framework 48 so as to extend rearward of and in front of the supporting wall 50, respectively. A coupling member in the form of an elongated plate 56 for coupling the front end portions of the partitions 54 is integrally formed therewith and has its lower portion turned rearward (FIGS. 1 and 2) for forming a passageway for record media. A plurality of supporting apertures or holes 58 and 60 are respectively formed and axially aligned in the supporting wall 50 and in the coupling member 56, respectively, between the partitions 52 and 54 and on the forward or front sides thereof.

There are provided seven sets of dot forming elements 62 (only one set is shown) between the individual partitions 52 and 54 and along the longitudinal direction of the platen 12, each set including one printing wire 64, shown as extending in exaggerated manner in FIG. 5, and an electromagnet 66 for moving the printing wire 64 back and forth relative to the head framework 48. A shaft-like portion 68 of each dot forming element 62 is pressed into the individual supporting holes 58 and 60 and fixed on the head framework 48 by a retaining ring 70, which is fitted into a groove 72 on the shaft portion 68 of the dot forming element 62 in front of the supporting wall 50. Thus, the printing wire or shaft tip 64 of each dot forming element 62 is disposed to be directed toward the platen 12 through the slits 28 and 24 of the paper guide 26 and of the rear portion 22 of the protection frame 20 for the platen 12. Each of the dot forming elements 62 takes charge of and accomplishes the printing of letters or characters and numerals occupying the space of three columns. It is seen from FIGS. 1, 2 and 5 that the print element assembly is comprised basically of the head. framework 48 and the dot forming elements 62.

Under the central portion of the head framework 48, a pair of follower pins 78 project downwardly through a forward cutout portion 80 of the base plate 42 at a predetermined position. A cam member 82 (FIGS. 1, 2 and 3), rotatably supported in integral manner with a pivot pin or shaft 84, is provided between the side walls 16 and 18 of the printer frame in a manner so as to position and transversely move the head frame 48 by means of the pins 78 being engaged in a spiral-like cylindrical cam 86 which is formed on the peripheral surface of the cam member 82. The follower pins 78 are in contact with both sides of the cam surfaces of the cylindrical cam 86. A print head driving motor 90 (FIG. 1) is provided and is supported from the printer frame in suitable manner adjacent the rear wall of the printer. When the cam member 82 is rotated together with the pivot pin or shaft 84 through suitable driving mechanism (not shown) by receiving rotational driving motion from the print head driving motor 90, the dot forming elements 62 are reciprocatingly moved in one cycle of operation with the head frame 48 through a space corresponding to three characters during one rotation of the cam member 82.

In the rear portion of the head framework 48, a guide rail 92 (FIGS. 1 and 2), of an inverted L-shaped configuration, is securely attached to the inner surface of a rear side wall 94 of the printer frame, and a guide member 96 is provided with a groove 98 (FIG. 1) which is in sliding contact with the upper and lower surfaces of the guide rail 92, the guide member 96 being attached to the rear upper surface of the head frame 48.

Figure 3:
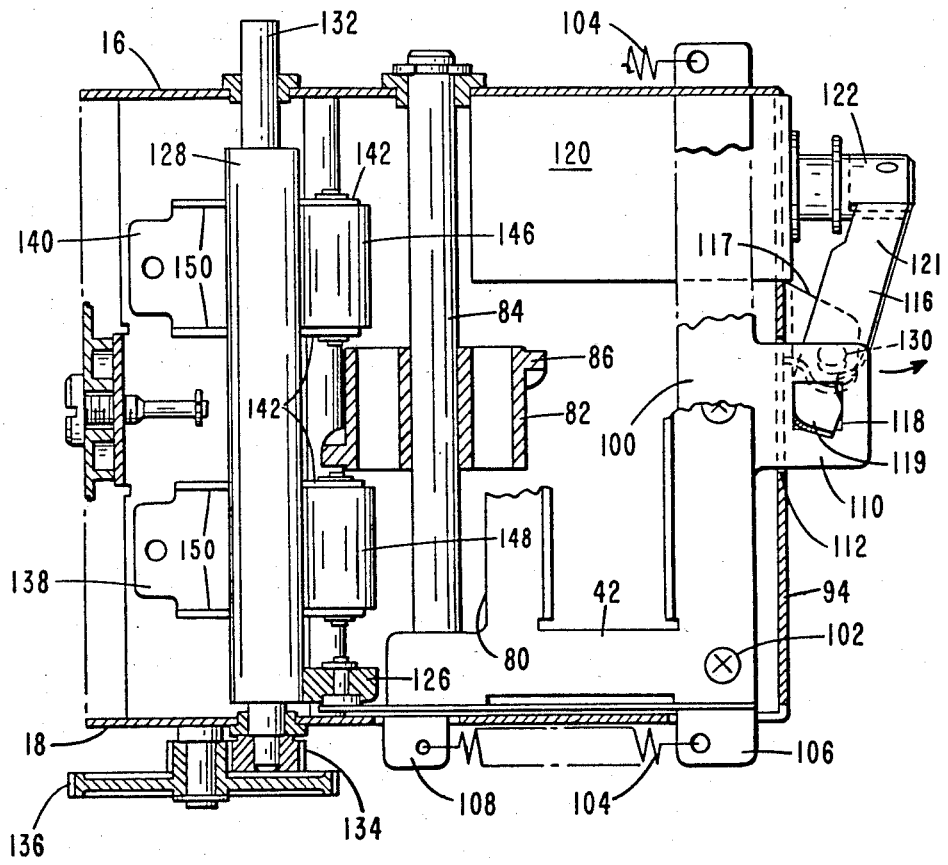
FIG. 3 is a plan view of the dot matrix printer with certain parts thereof removed for clarity.
Figure 4:
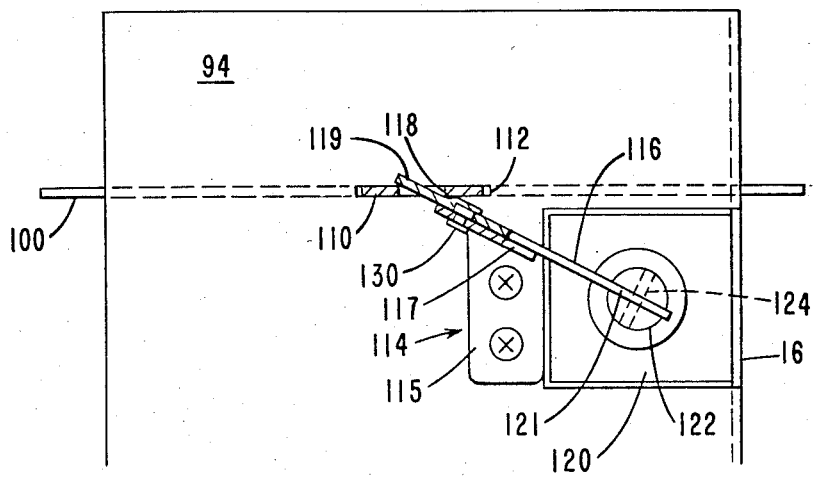
FIG. 4 is a rear view of the printer showing the location and arrangement of the printing element support moving means.

As also shown in FIGS. 3 to 5, an elongated lever plate 100, which extends beyond the walls 16 and 18, is securely attached to the rear lower surface of the base plate 42 (FIGS. 1 and 2) by means of a plurality of screws 102, and tension springs 104 (FIG. 3) are attached between the projecting portions 106 of the lever plate 100 and corresponding projecting tongues 108 (FIG. 3) provided on the side walls 16 and 18, respectively. Thus, the head framework 48 together with the base plate 42 (FIGS. 1 and 2) is moved toward the platen 12 with the aid of the spring force or urging of the tension springs 104.

A connecting tongue 110 is formed in the center of the rear edge of the elongated lever plate 100 and projects through a slit 112 in the rear side wall 94 of the printer frame toward the outside thereof. Further, a supporting arm 114 is positioned adjacent the connecting tongue 110 and is securely attached to the outer surface of the rear side wall 94, as shown in FIGS. 3 and 4. The supporting arm 114 includes a vertical portion 115 secured to the rear wall 94 with two screws, and an angular portion 117 extending outwardly from the wall 94 and under the tongue 110. A coupling lever 116 is rotatably connected with and supported from the supporting arm 114 in a manner comprising a driving mechanism wherein one end 119 of the coupling lever 116 is inserted into a square hole 118 formed in the connecting tongue 110.

As shown in FIGS. 3 and 4, a solenoid 120 (FIG. 3) is provided and is suitably secured to the inner surface of the printer frame at the rear thereof and a plunger 122 of such solenoid 120 extends to the outside through the rear side wall 94. The other end 121 of the coupling lever 116 is pivotably mounted on a pin 124 driven into and secured in the end of the plunger 122, as seen in FIG. 4. Further it is noted that a pair of rollers, as at 126 (FIGS. 3 and 5), are respectively supported from the front end inner surface portions of the left and right upright members 46 (FIG. 5) of the base plate 42.

When the solenoid 120 is in the de-energized condition, the base plate 42 and the head framework 48 are moved toward the platen 12 together with the elongated lever plate 100 by the force of the tension springs 104, as shown in FIG. 3, and each of the rollers 126 is engaged with a feed roller 128 (FIG. 1), the function of which will be described later. Thus in such de-energized condition of the solenoid 120, the base plate 42 is disposed in the front or forward position, as shown in FIG. 1. A predetermined space of a thickness corresponding to the total thicknesses of the printing paper 129 (FIG. 2) and a predetermined printing space is formed between the tip of the printer wire 64 of each dot forming element 62 on the head framework 48 and the periphery of the platen 12, owing substantially to the abutment of the roller 126 against the printing paper, as shown in FIG. 1.

On the other hand, when the solenoid 120 is energized, the plunger 122 is moved to the retracted position (not shown but toward the left in FIG. 3) from its extruded position (as illustrated in FIG. 3) so that the coupling lever 116 is rotated about a stud 130 on the angular portion 117 of the supporting arm 114 (FIG. 4) in the counterclockwise direction, as shown by the arrow in FIG. 3. Accordingly, the print wire 64 of each dot forming element 62 is moved away from the platen 12 together with the head framework 48 (which is attached to the elongated lever plate 100) and with the base plate 42, all against the strain or urging force of the tension springs 104, wherein the predetermined space is effected between the tip of the printing wire 64 of each of the dot forming elements 62 and the platen 12.

As shown in FIGS. 1 to 3, the feed roller 128 is rotatably supported from the side walls 16 and 18 via a pivot shaft 132 extending therebetween and journaled therein in position under the platen 12, and such roller is rotated in a predetermined direction by a suitable feed driving motor (not shown) through a gear drive assembly consisting generally of a driven gear 134 fixed to one end of the pivot shaft 132 and an intermediate gear 136 suitably supported from the side wall 18 and engaging with the driven gear 134. The feed driving motor (not shown) also acts as the platen driving motor and rotates the platen 12 in synchronism with the feed roller 128 through a suitable transmission mechanism (not shown).

A pair of roller supporting members 138 and 140 (FIG. 3) are rotatably mounted adjacent the feed roller 128 by means of respective pairs of bent portions 142 provided on the upper ends of each of such supporting members 138 and 140, (FIGS. 1 and 3), which members are carried on a shaft or rod 144 that is supported from and extends between the side walls 16 and 18. A pair of push rollers, as 146 and 148, are rotatably supported respectively between the upper ends of the bent portions 142 of the roller supporting members 138 and 140, and each of the push rollers 146 and 148 is pressed into contact with and separated from the feed roller 128 upon rotation or swinging movement of such roller supporting members 138 and 140. A pair of upwardly extending projections, as at 150, are formed on the supporting members 138 and 140 at the other side of the roller 128 from the bent portions 142 (FIG. 3).

Further, it is seen that under the individual roller supporting members 138 and 140, a pair of solenoids, as 152 (FIGS. 1 and 2), are mounted on a bottom portion 154 of the printer frame, and mounting plates, as at 156, of the roller supporting members 138 and 140 are connected to plungers 158 of the respective solenoids 152. The mounting plates 156 are formed as angles extending from the plungers 158 up and over the top of the solenoids 152. In addition, coil-type tension springs 160, effective in the operation for rotating and actuating the roller supporting members 138 and 140 in the direction of pressing the push rollers 146 and 148 into contact with the feed roller 128, are stretched between and connected to the upper portion of the mounting plates 156 for the roller supporting members 138 and 140 and the bottom portion 154 of the printer frame. Thus, when the solenoids 152 are in the de-energized condition, the push rollers 146 and 148 are moved or swung counterclockwise on shaft 144 into contact with the feed roller 128 by the force and urging of the tension springs 160, as shown in FIG. 1. On the other hand, when the solenoids 152 are energized, the roller supporting members 138 and 140 are rotated or swung on shaft 144 in the clockwise direction, as seen in FIG. 2, against the force of the tension springs 160 and hence the push rollers 146 and 148 are disposed in positions separated from the feed roller 128.

The guide plate 40 (FIGS. 1 and 2), alluded to above, is provided and positioned between the side walls 16 and 18 and under the platen 12 so as to cover the lower surfaces of the feed roller 128 and the ink roller 34. A substantially J-shaped leaf spring 164 is attached to the guide plate 40 at the base end thereof (toward the front of the printer) so as to oppose the projections 150 of the roller supporting members 138 and 140 and extends downwardly through the slit in the guide plate 40. A curved paper guide 166 extending upwardly and rearwardly toward the feed roller 128 from the front of the solenoid 152 is removably attached to a vertical plate 168, rising at the forward edge of the bottom portion 154, by means of a screw 170. The curved paper guide 166 is formed and positioned to guide and support the paper 129 in continuous manner. A pair of slits 172 are provided in the paper guide 166 to permit the projections 150 of the roller supporting members 138 and 140 to pass through and extend above the upper surface of the paper guide 166.

It is thus seen that when the solenoids 152 are in the de-energized condition, as illustrated in FIG. 1, the projections 150 of the roller supporting members 138 and 140 are retracted through the slits 172 by tension of the coil springs 160 to effect predetermined spaces between the projections 150 and the leaf springs 164. Therefore, in this state or condition, the paper 129 can be fed in continuous manner freely from the front of the printer frame along the upper surface of the paper guide 166 between the projections 150 of the roller supporting members 138 and 140 and the J-shaped leaf springs 164 and then toward the feed roller 128.

On the other hand, when the solenoids 152 are energized, the projections 150 of the roller supporting members 138 and 140 emerge out over and above the paper guide 166 through the slits 172, as shown in FIG. 2, to engage with the leaf springs 164, and the push rollers 146 and 148 are separated and positioned from the feed roller 128, as mentioned above. Accordingly, the head framework 48 is positioned in the rear position, as shown in FIG. 2, and in this state or condition, a separate sheet of paper or record media, as 129, can be inserted from the upper portion of the machine and passed between the print wires 64 of the dot forming elements 62 on the head frame and the platen 12, and then between the feed roller 128 and the push rollers 146 and 148. The position and path of the inserted paper can be provided and accommodated by bringing the lower edge of the paper 129 into contact with the upper end of the paper guide 166.

In addition, other features include a cover member 174 (FIG. 1), for covering the ink roller 34, provided above the front portion of the frame and between the side walls 16 and 18, and a cover 176, shown in phantom line, provided for covering the head frame 48 on the upper surface of the printer frame. A cutter 178 is provided also at the forward edge of the cover 176 for cutting the continuous paper.

The operation of the dot matrix printer constructed in accordance with the above-mentioned subject matter will now be described. First, when inserting a separate sheet of paper 129 (FIG. 2) between the platen 12 and the print wires 64 of the dot forming elements 62, the solenoid 120, shown in FIGS. 3 and 4, is energized to permit the plunger 122 to move toward the retracted position, to the left or toward the front of the printer, and to rotate the coupling lever 116 in the counterclockwise direction, as shown by the arrow in FIG. 3. Accordingly, the base plate 42 and the head framework 48 are shifted toward the rear of the printer (to the right in FIGS. 1–3) together with the elongated lever plate 100 through the action of the connection between the one end 119 of the coupling lever 116 and the square hole 118 in the lever plate 100, all against the actuating or urging force of the tension springs 104. The bottom of the groove 98 formed in the guide member 96 (FIGS. 1 and 2) on the head framework 48 is engaged with the forward edge portion of the guide rail 92 to provide the position of the head framework 48 and hence dispose such head frame in the position, as shown in FIG. 2.

When the rearward (toward the right in FIGS. 1 and 2) movement of the head frame 48 is completed, the print wires 64 of the dot forming elements 62 are separated from the platen 12 and predetermined spaces are formed therebetween, as shown in FIG. 2.

Next, when the pair of solenoids 152 (only one being shown) shown in FIG. 1 are energized, the plunger 158 is moved toward the retracted position (to the left as shown in FIG. 2) and the roller supporting members 138 and 140 are rotated or swung in the clockwise direction against the actuating or urging force of the tension springs 160. This action separates the push rollers 146 and 148 on the supporting members 138 and 140 from the feed roller 128 to the position shown in FIG. 2, and raises the projections 150 of the roller supporting members 138 and 140, such projections 150 passing through the slits 172 over the paper guide 166 and into engagement with the corresponding leaf springs 164.

Accordingly, when the separate sheet of paper is inserted between the paper guide 166 and the head framework 48 from above the printing mechanism (FIG. 2), the paper can be directed to the upper end of the paper guide 166 in passing between the push rollers 146 and 148 and the feed roller 128. The lower end of the paper is then engaged with the upper end of the paper guide 166 at the predetermined position.

When the solenoids 152 are de-energized, the roller supporting members 138 and 140 are rotated in the counterclockwise direction and are returned to the original position, as shown in FIG. 1, with the aid of the actuating or urging force of the springs 160. The push rollers 146 and 148 are pressed into contact with the feed roller 128 by this action, and the paper 129 is held between the feed roller 128 and the push rollers 146 and 148. Then, when the solenoid 120, shown in FIGS. 3 and 4, is de-energized, the lever plate 100, the base plate 42 and the head framework 48 are integrally moved toward the platen 12 with the aid of the actuating force of the tension springs 104, and the roller 126 on the base plate 42 engages with the outer periphery of the feed roller 128 to stop the movement. Hence, a portion of the paper 129 is held between the front face of the head framework 48 and the surface of the paper guide 166.

In this embodiment, since the dot matrix printer is arranged such that the head framework 48 is supported so as to be movable toward and away from the platen 12 on the base plate 42 therewith, the platen 12 and the paper guide 26 can always be held in the predetermined positions with respect to the printing paper 129 upon the insertion of the printing paper, and therefore the printing paper 129 is free from stain which may be caused by the contact of the inked platen 12 with the printing paper. To the contrary, if the dot matrix printer 10 would be constructed so that the platen 12 is separated from but is very near the head frame 48 upon the insertion of the printing paper 129, the portion of the platen 12 coming into contact with the surface of the printing paper 129 through the slit 28 in the paper guide 26 when the head frame 48 is moved toward the platen 12 causes the printing paper to be disadvantageously stained with ink from the platen owing to an error occurring when the platen 12 and the paper guide 26 are assembled or built.

When the dot forming elements 62, the print head driving motor 90 and the feed drive motor (not shown) are operated, the feed roller 128 is rotated in the predetermined direction in synchronism with the rotation of the platen 12 and the ink contained in the inking roller 34, which rotates in association with the platen 12, is transferred to the outer peripheral surface of such platen 12.

In addition, under the operation of the dot forming elements 62, the printing wires 64 in the selected ones of the dot forming elements 62 are projected toward the platen 12 and the paper 129 is partially pressed into contact with the outer periphery of the platen 12 by the projection of the printing wires 64 to form dots on the paper 129 opposite the dot forming elements 62. On this occasion, the remaining portion of the paper 129 on which no dots are formed is not pressed into contact with the platen 12 because of being intercepted by the paper guide or shield 26, so that there is no disadvantage of the remaining portion being stained with the ink from the platen 12.

After printing a line of dots, the cam member 82 is rotated in the predetermined direction with the pivot shaft 84 in accordance with the operation of the print head driving motor 90, and the dot forming elements 62 are shifted along the print line of the platen 12 in the predetermined direction together with the head framework 48 via movement of the follower pins 78 which are engaged in the cylindrical cam 86, and another or a following line of dots may be printed. In this manner, the sheet of paper 129 is fed upward by one dot line in accordance with the cooperation of the feed roller 128 and the push rollers 146 and 148 which are rotated with the operation of the feed drive motor (not shown).

Letters or characters consisting of dots arranged in a matrix of 21 columns are printed on the line during the half-cycle of rotation of the cam member 82 by repeating the above-mentioned operation and then the paper 129 is spaced up in accordance with the cooperation of the feed roller 128 and the push rollers 146 and 148. In this manner, each one of the forming elements 62 takes charge of and effects the printing of three letters or characters during the transverse movement of the head framework 48.

Accordingly, in the dot matrix printer 10 according to this embodiment, since seven dot forming elements 62, each being provided with one printing wire 64, are mounted in line manner on the head frame 48, it is possible to print a large number of characters with a slight movement of the head frame, and it is seen that the entire structure of the device is more compact, which feature makes the printer more favorable as a printer for use in a cash register. Further, since the individual dot forming elements 62 are mounted along a line in the longitudinal direction of the platen 12, the diameter of the platen can be reduced from the case wherein a print head having a plurality of printing wires mounted in upper and lower fashion or in a vertical line is used, and it is also seen that the space occupied by the print section can be made narrower than in the case wherein the print head uses a plurality of printing wires arranged in a circle.

It is seen that in one instance in the practice of the present invention, that when letters or characters are to be printed on a continuous form type paper, if the upper portion of the paper is inserted into the lower front portion of the printer frame along the paper guide 166, the roller supporting members 138 and 140 and the head framework 48 are positioned as shown in FIG. 1. The upper end of the paper can be inserted into the position in an attitude wherein the feed roller 128 is engaged with the push rollers 146 and 148 and wherein the paper passes in a path between the projections 150 and the leaf springs 164 and between the guide plate 40 and the paper guide 166. When the feed roller 128 is rotated in this state or condition, the continuous form paper then can be directed between the paper guide 26 and the front face of the portion 56 of the head framework 48.

In another instance in the practice of the present invention, as in the case where the printing operation is made on a separate sheet of paper as mentioned above, the head framework 48, the dot forming elements 62, the platen 12 and the feed roller 128 are respectively operated to print on the platen side (rear side) of the paper 129. In order to stop the paper feed at the completion of the printing operation, the solenoids 152 are de-energized to enable rotation of the roller supporting members 138 and 140 in the clockwise direction, as shown in FIG. 1. In accordance therewith and in such position of the supporting members 138 and 140, the continuous form paper is held between the projections 150 of such supporting members and the leaf springs 164, and the push rollers 146 and 148 are moved away from the feed roller 128, thereby stopping the feed of the continuous paper.

It is also seen that in case of printing with narrow separate sheets of paper, either one of the solenoids 152 can be actuated to provide the feed of the paper by use of either push roller 146 or 148.

As has been described above, the first inventive feature of the present invention has the effect that since the plurality of dot forming elements 62, each being provided with one printing wire 64, are mounted in or along a line in the longitudinal direction of the platen 12, the diameter of the platen 12 and the moving distance of the print head can be reduced and hence the entire structure of the device can be made compact. Since the ink supply means 34 adapted to supply ink to the surface of the platen 12, and the guide means 26 adapted to guide and support the printing paper between the platen and the head framework are such that the printing paper 129 is not always in contact with the surface of the platen 12, the ink ribbon and an associated ribbon feed mechanism can be eliminated and hence the structure can be simplified and manufactured at lower costs.

The second inventive feature of the present invention has the effect that since the supporting member 42, adapted to support the head frame 48, is constructed so as to be movable toward and away from the printing surface of the platen 12, the spring members 104 are adapted to urge the supporting member 42 toward the platen 12, and the driving means 120 is adapted to move the supporting member 42 away from the platen 12. Since the ink coated platen 12 can always be held in the predetermined position adjacent the printing paper 129, the printing paper is prevented from being stained which may be caused by contact of the platen 12 with the print paper.

It is thus seen that herein shown and described is a dot matrix printer that provides guide means for preventing ink stain on the printing paper, that provides an ink coated platen which replaces the commonly used ink ribbon and associated ribbon feed mechanism, and that provides means for moving the print wires toward and away from the platen. The mechanism and arrangement enables the accomplishment of the objects and advantages mentioned above, and while a preferred embodiment of the invention has been disclosed herein, variations thereof may occur to those skilled in the art. It is contemplated that all such variations not departing from the spirit and scope of the invention hereof are to be construed in accordance with the following claims.

We claim:

1. A dot matrix printer comprising a platen pivotally supported by the printer, first supporting means comprising a carriage having individual housings for and supporting a plurality of spaced, transversely aligned print elements and movable transversely across the printer and along the platen, each of the print elements having a printing wire actuated to be moved toward and away from the platen, roller means for supplying ink onto the surface of the platen, means for guiding record media along a path between the platen and the first supporting means and being spaced from the platen, the movement of each of the printing wires pressing the record media against the platen for printing on the opposite side of the media from the printing wires, first drive roller means supported by the printer, second drive roller means opposed to said first drive roller means and cooperable with said first drive roller means to selectively drive the record media, second supporting means comprising a base plate operably connected for supporting the first supporting means for moving said first supporting means toward and away from the platen and having shaft means enabling transverse movement of the first supporting means along the platen, said base plate having rollers thereon engageable with the first drive roller means providing predetermined space for passage of the record media between the platen and the printing wires, and means operably associated with the second supporting means for urging said second supporting means toward the platen and for moving the second supporting means along with the first supporting means away from the platen to permit insertion of the record media between the platen and the print wires.

2. The dot matrix printer of claim 1 wherein the record media guiding means comprises an elongated member positioned between the platen and the print elements and defines a window therein for passage of the printing wires therethrough.

3. The dot matrix printer of claim 1 including resilient means for biasing the second supporting means in the direction of the platen.

4. The dot matrix printer of claim 1 wherein the moving means includes a solenoid positioned on the printer to move the first supporting means away from the platen.

5. The dot matrix printer of claim 1 wherein the second supporting means includes a projection of the base plate having a slot therein and the moving means includes a coupling lever member having one end thereof operable in the slot and pivotable for moving the second supporting means along with the first supporting means away from the platen.

6. In a dot matrix printer having a frame, a platen pivotally supported from the frame, a plurality of spaced print elements movable across the printer and along a line of printing, a first supporting member comprising a framework having individual housings for supporting the print elements for movement along the line of printing, roller means for supplying ink onto the surface of the platen, means positioned between the platen and the print elements for guiding record media in a path spaced from the platen, actuation of the print elements causing contact of the record media against the platen for printing on the record media, first drive means comprising an elongated roller supported by the printer, second drive means comprising a pair of rollers opposite said elongated roller and cooperable with said first drive means to selectively drive the record media, a second supporting member comprising a base plate operably connected for supporting the first supporting member and movable toward and away from the platen and having a shaft member enabling transverse movement of the first supporting member along the platen, said base plate having a pair of rollers thereon engageable with the elongated roller for providing a predetermined space for passage of the record media between the platen and the print elements, and actuating means operably associated with the second supporting member for moving said second supporting member and for displacing the first supporting member in a direction away from the platen to permit insertion of the record media between the platen and the print elements.

7. In the dot matrix printer of claim 6 wherein the record media guiding means comprises an elongated member positioned between the platen and the print elements and is formed to direct the record media adjacent the print elements.

8. In the dot matrix printer of claim 6 including resilient means for biasing the second supporting member in the direction of the platen.

9. In the dot matrix printer of claim 6 wherein the actuating means comprises a solenoid.

10. In the dot matrix printer of claim 9 wherein the second supporting member includes a projection of the base plate defining a slot therein and the actuating means includes a coupling lever member having an end portion thereof operable in the slot and pivotable for moving the first supporting member and the second supporting member away from the platen.

* * * * *